US008162157B2

(12) United States Patent
Brown et al.

(10) Patent No.: US 8,162,157 B2
(45) Date of Patent: Apr. 24, 2012

(54) COLLAPSIBLE BOW AND ARROW STAND

(75) Inventors: Stanley Neil Brown, Hallettsville, TX (US); Kenneth Earl Johnson, Hallettsville, TX (US)

(73) Assignee: Bowsaver Inc, Hallettsville, TX (US)

( * ) Notice: Subject to any disclaimer, the term of this patent is extended or adjusted under 35 U.S.C. 154(b) by 364 days.

(21) Appl. No.: 12/462,096

(22) Filed: Jul. 28, 2009

(65) Prior Publication Data

US 2011/0024374 A1 Feb. 3, 2011

(51) Int. Cl.
*A47F 7/00* (2006.01)

(52) U.S. Cl. ..... 211/85.7; 211/196

(58) Field of Classification Search ..... 211/85.6, 211/203, 197, 205, 207, 208, 60.1, 85.7, 211/70.5, 70.2, 64, 33, 196; 248/166, 161, 248/157; 206/315.1, 315.11; D6/552; 124/1, 124/86

See application file for complete search history.

(56) References Cited

U.S. PATENT DOCUMENTS

| | | | | | |
|---|---|---|---|---|---|
| 1,564,089 | A * | 12/1925 | Maxwell | 124/24.1 |
| 1,851,779 | A * | 3/1932 | Slater | 211/60.1 |
| 2,593,789 | A * | 4/1952 | Pearson | 211/85.7 |
| 3,584,820 | A * | 6/1971 | Butcher, Sr. | 248/122.1 |
| 3,926,393 | A * | 12/1975 | Tainsh | 248/165 |
| 4,429,861 | A * | 2/1984 | Range | 269/40 |
| 4,474,296 | A * | 10/1984 | Hartman | 211/85.7 |
| 5,240,211 | A * | 8/1993 | Anderson | 248/125.3 |
| 5,454,473 | A * | 10/1995 | Hennessey | 211/85.6 |
| 6,948,694 | B1 * | 9/2005 | Gilbert | 248/530 |
| 7,047,960 | B2 * | 5/2006 | McCrea | 124/86 |
| 7,360,532 | B1 * | 4/2008 | Reynolds et al. | 124/1 |
| 2006/0180558 | A1 * | 8/2006 | Engberg | 211/60.1 |

* cited by examiner

*Primary Examiner* — Darnell Jayne
*Assistant Examiner* — Patrick Hawn
(74) *Attorney, Agent, or Firm* — James J. Mullen

(57) ABSTRACT

The present invention provides a unique compound bow stand and quiver holder which is quickly collapsible and stored and transported in an easy manner for persons in the archery industry and field.

1 Claim, 5 Drawing Sheets

COLLAPSIBLE BOW AND ARROW STAND

FIELD OF THE INVENTION

This invention relates to a stand and, more particularly, to a collapsible bow and arrow stand for holding compound bows and arrows.

DESCRIPTION OF THE PRIOR ART

Unlike conventional bows, compound bows are not unstrung, but are left in a strung condition for storage and transport purposes. Accordingly, the compound bows need to be placed in a holder, rack or stand which will support them in an appropriate manner. Compound bows are quite expensive, sophisticated in mechanical makeup and involve numerous parts that can be damaged if not handled with care. For example, a typical compound bow is comprised of a pair of limbs, a cam at each end of each limb, and a bow string connected to the cams. A number of different types of rack or stand apparatus have been proposed for holding bows, but typically they have been for bows of the prior art, and few have been designed for holding compound bows and arrows in a stable manner when used in the field.

Examples of a holder apparatus for the prior art bows include U.S. Pat. No. 233,667. This patent discloses a collapsible rack which holds a number of unstrung bows in a vertical and generally parallel orientation. The rack apparatus includes a number of slots and indentations for bows and arrows.

Another holder apparatus for bows and arrows is shown in U.S. Pat. No. 1,851,779. The '779 apparatus is a collapsible bow and arrow stand which is designed to be used in the field. It includes a shaft which extends vertically and is embedded in the ground. A transverse bracket holds the bow, while hooked elements hold elements.

U.S. Pat. No. 2,275,870 discloses a rack apparatus similar to that of the '779 patent. The apparatus includes a shaft which is embedded in the ground and includes a holder bracket for a bow as well as brackets for holding arrows.

U.S. Pat. No. 2,593,789 is similar to both the '870 and '779 patents. It is also designed with a shaft to be embedded into the ground, a bracket for holding the bow, and rack elements for holding arrows.

U.S. Pat. No. 3,221,957 discloses a holder apparatus for arrows. The apparatus includes a canister for holding arrows and support elements for supporting the canister.

U.S. Pat. No. 3,256,872 discloses a collapsible stand for holding a bow. The apparatus is in a general configuration of a tripod, with the lower portion of the bow comprising a third leg. The holder or stand apparatus of the '872 patent includes two legs, and the bottom portion of the bow comprises the third leg of a tripod.

U.S. Pat. No. 3,584,820 discloses a holder for a bow and a holder for arrows. The apparatus includes a base, with a vertical element to which brackets are secured for the bow, a quiver element also secured to the base. The apparatus may also be used as a support for a rifle.

U.S. Pat. No. 3,840,282 discloses a storage rack for hunting arrows. The apparatus is in the configuration of a cabinet, with pivoting door elements to provide access to a cabinet which holds arrows. A pair of brackets on one of the door elements holds a bow.

U.S. Pat. No. 3,926,393 discloses a collapsible bow and arrow stand which includes a tripod base and an element extending vertically upward from the tripod base. The vertical element includes a bracket which holds a bow, and a quiver is fastened to the vertical element.

U.S. Pat. No. 4,360,179 discloses a stand for supporting a compound bow. The stand included a pair of legs secured to a main stand portion, and the lower portion of the main stand comprises a third leg of a tripod. The compound bow is disposed against the main stand portion.

U.S. Pat. No. 4,474,296 discloses another stand for a compound bow. The apparatus include a base and a vertical element extending upwardly from the base. The compound bow is disposed in a bracket secured to the vertical element. A quiver for arrows is also secured to the base and to the vertical element.

U.S. Pat. No. 4,542,873 discloses another holder for supporting a bow and includes a bow supporting extension which is releasable and adjustably secured to a bracket.

U.S. Pat. No. 4,729,363 discloses a support element for a compound bow. The support element is secured to a tree stand. The apparatus includes a pair of bracket elements secured to the tree stand. One of the bracket elements extends downwardly from the tree stand and receives the bottom or lower portion of the bow, and the other bracket extends outwardly from the tree stand and supports the bow in an upright orientation.

U.S. Pat. No. 5,725,106 discloses a rectangular shaped rack for holding and supporting compound bows.

U.S. Pat. No. 7,347,402 discloses an archery bow support mechanism having a tripod base with the bow mechanically affixed to the top portion thereof.

None of the apparatus disclosed in the above cited prior art are designed to hold a compound bow in a vertical, stable manner whether in a storage manner or in the field, and particularly during competitive archery shows. The sport of archery has become very popular in recent years and which has resulted in the tournaments at various levels of competence. During any such tournament, the archer must, like any sport, concentrate upon and direct his attention to the matter of accurately aiming and releasing the arrow. Any superficially imposed detractions from this purpose negatively affect the archer's power of concentration. The archer, whether participating in a sporting activity or pursuing a competitive endeavor, usually does so from a fully erect position. Since most activities take place in an open area where there are no trees or bushes against which bow and arrows may be leaned, the archer must erect an impromptu stand or place his equipment upon the ground when not in use. An impromptu stand is invariably only tolerably sufficient and may exasperate or otherwise completely destroy the archer's power of concentration. If the bow, arrows and other equipment must be laid on the ground, the archer is seriously inconvenienced and the items might easily be stepped upon by the archer himself or by passersby. Furthermore, the bows and arrows can become cover with dirt and damaged by articles on the ground itself. For example, the ground may be muddy, wet or covered with snow. If the bow is laying on the ground, it can easily be contaminated by mud, water or snow. This inconvenience and contingent damage also deleteriously affects the archer's concentration upon the task at hand. Thus, the above cited art does not fully meet the needs of the archer by having and providing a fully collapsible bow stand and arrow holder and which is highly stable, adjustable in height, and well balanced in the place of use. The apparatus of the present invention can be easily transported and quickly assembled.

SUMMARY OF THE INVENTION

It is an object of the present invention to provide a means for holding compound bows in the field and which means provides stability, a height adjustable feature, and balanced orientation to facilitate such bows. It is also an object of the present invention to provide a stand for compound bows and which is quickly collapsible and can readily be stored in an efficient manner. These and other objects and advantages of the invention will become readily apparent as the following description is read in conjunction with accompanying drawings.

DETAILED DESCRIPTION OF THE PREFERRED EMBODIMENTS

Figure 1:
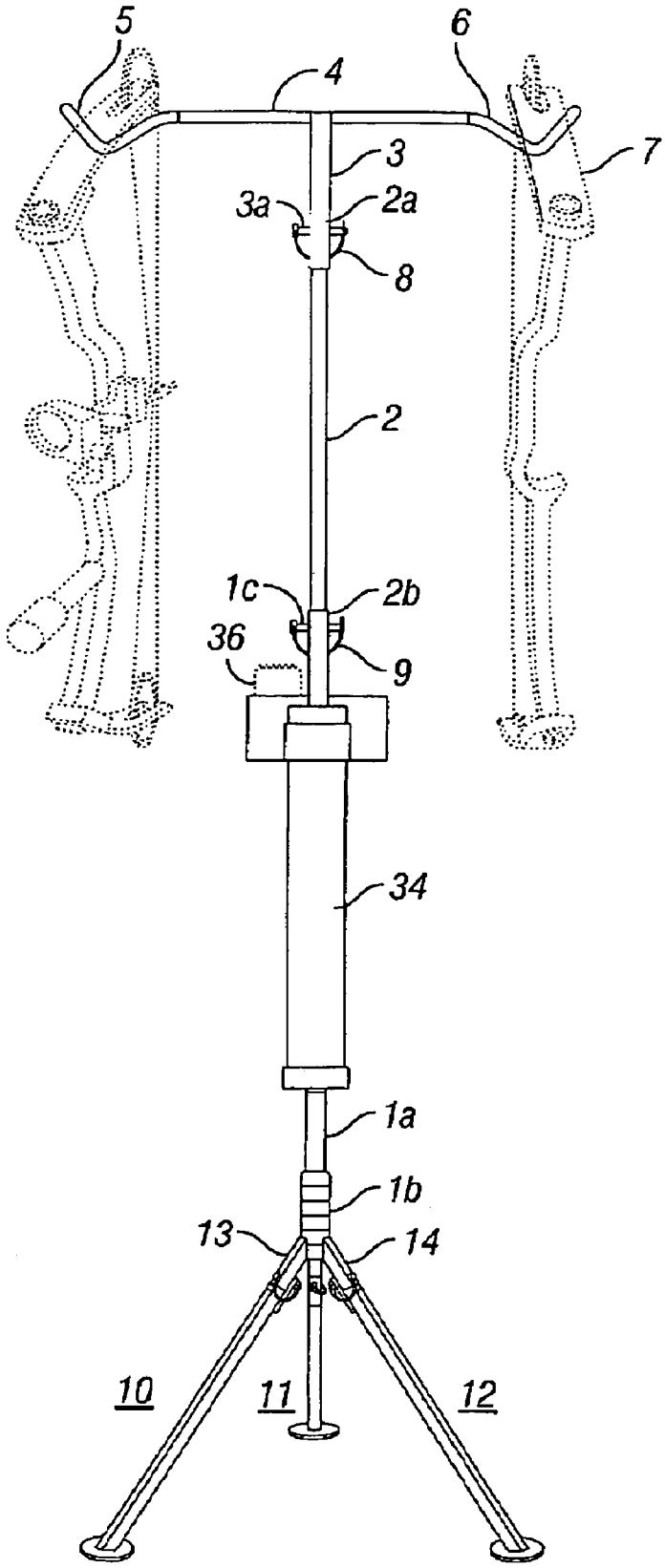
FIG. 1 illustrates the present invention in use with compound bows being supported by the stand.

In conjunction with the following disclosed embodiment of the present invention in detail, it is to be understood that the invention is not limited in its application to the details of the particular arrangement shown, since the invention is capable of other embodiments. Furthermore, the terminology used herein is for the purpose of description and not of limitation.

The present invention is directed toward a unique stand to be-used during archery. It is well known that an archer's arm suffers stress while shooting because of the tension of the bow-string, the precise aiming, and the weight of the bow. Such tension leads to fatigue and wavering of the arm, which lessens the archer's accuracy. In order to address this issue, the present invention provides a stand and arrow holder on which the compound bow can be rested, and which removes the weight of the bow from resting entirely on the archer's arm. Further, the present invention also steadies the bow from downward movement from a wavering hand, since it can readily be removed from the stand in an instant and at the same height as the archer is standing.

As shown in the FIGS., the stand of the present invention is formed of three separate and individual components and which comprises a first elongated housing member 1, comprising an upper portion 1*a* which is hollow and contains at least one aperture or hole 1*c* (not shown) therein and a bottom portion 1*b* having affixed thereto multiple legs 10, 11, and 12 and which support said member 1. The second component comprises an elongated housing member 2 having at least two apertures, 2*a* and 2*b* (not shown) therein, and which permit the respective apertures to be so aligned to allow pins 8 and 9 to be inserted there through and thus lock together members 1 and 2 in a stable manner. The third component comprises an elongated housing member 3 having at least one aperture therein 3*a* (not shown) and a lateral extending member 4 affixed to the upper portion of said member 3. Member 4 has depressions 5 and 6 in the outer portions of member 4 and which'permit the compound bows, such as 7, to be safely hung there from. Depressions 5 and 6 may be coated with a plastic dip coating containing tinted or colored chemicals to impart not only energy absorbing features for contacting with the compound bow, but also for adding an ascetic feature thereto. Apertures 2*a* and 3*a* are aligned in such a manner that a pin 8 can be inserted there through and thus align and lock together members 2 and 3 in a stable manner.

Figure 2:
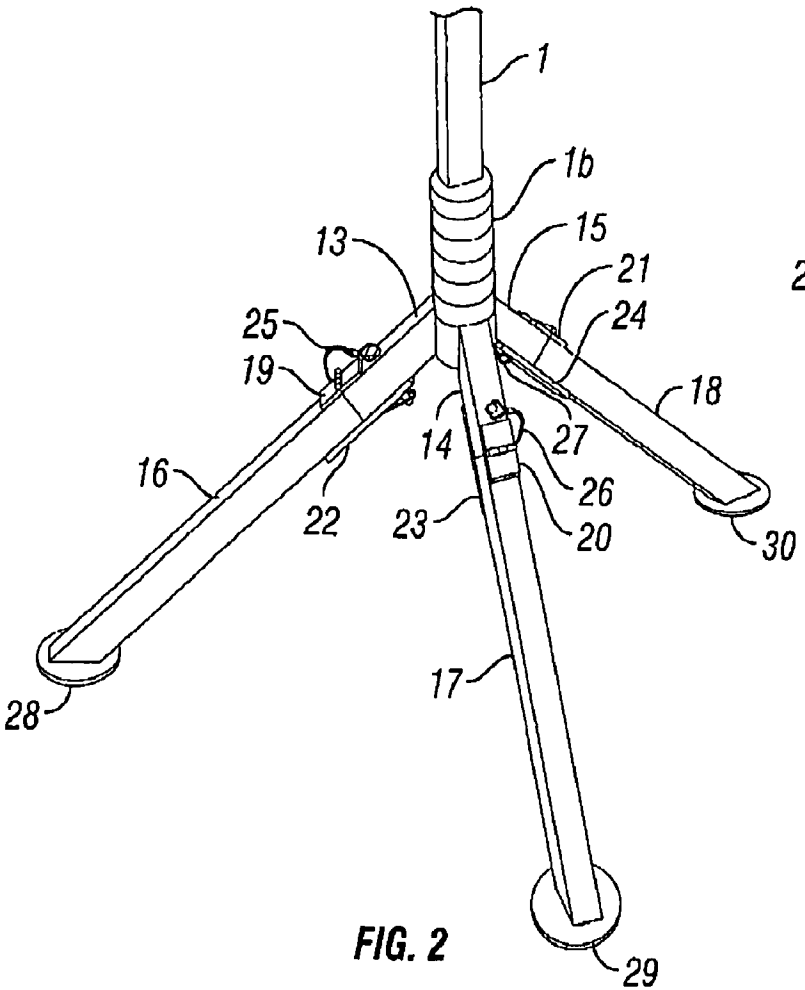
FIG. 2 illustrates the individual legs in a fully, locked extended position.

FIG. 2 illustrates the lower housing member 1 with the legs 10, 11, and 12 in a fully extended and locked manner when the stand is in use. Legs 10, 11, and 12 are fixedly attached to the lower portion lb of member 1 such as by welding the legs thereto, The upper portion of legs 10, 11, and 12 are designated 13, 14, and 15 and are connected to the lower portion of legs 10, 11, and 12, designated 16, 17, and 18, by hinge mechanisms 19, 20, and 21. On the opposite side of hinges 19, 20, and 21 there is affixed flanges 22, 23, and 24 respectively and these are located on the uppermost portion of lower members 16, 17, and 18. Flanges 22, 23, and 24 extend beyond the upper most portion of members 16, 17 and 18 in order to provide a means to align the members 13, 14, and 15 in a parallel manner. Furthermore, members 13, 14, and 15 and flanges 22, 23, and 24 have apertures (such as 22*a*, 24*a*, 15*a*) therein to permit pins 25, 26 and 27 to be inserted there through and lock the members 13, 14, and 15, respectively, with members 16, 17, and 18. As further means of providing stability for the overall stand, there are provided members 28, 29, and 30 at the lower end of members 16, 17, and 18. These members 28, 29, and 30 are larger than the cross section of members 15, 17, and 18, and can be similar or dissimilar in shape as the members 16, 17 and 18. Such members 28, 29, and 30 are preferably circular or elliptical in shape.

Figure 3:
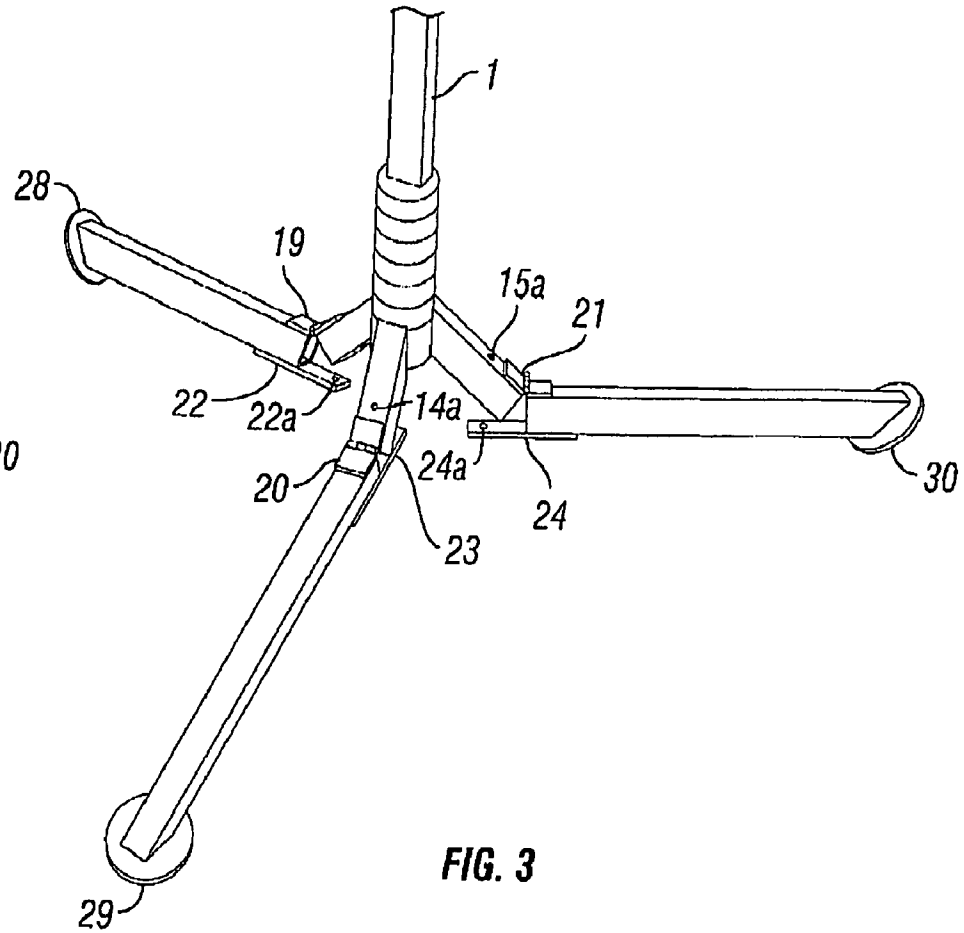
FIG. 3 illustrates the individual legs in an unlocked, partially raised position.
Figure 4:
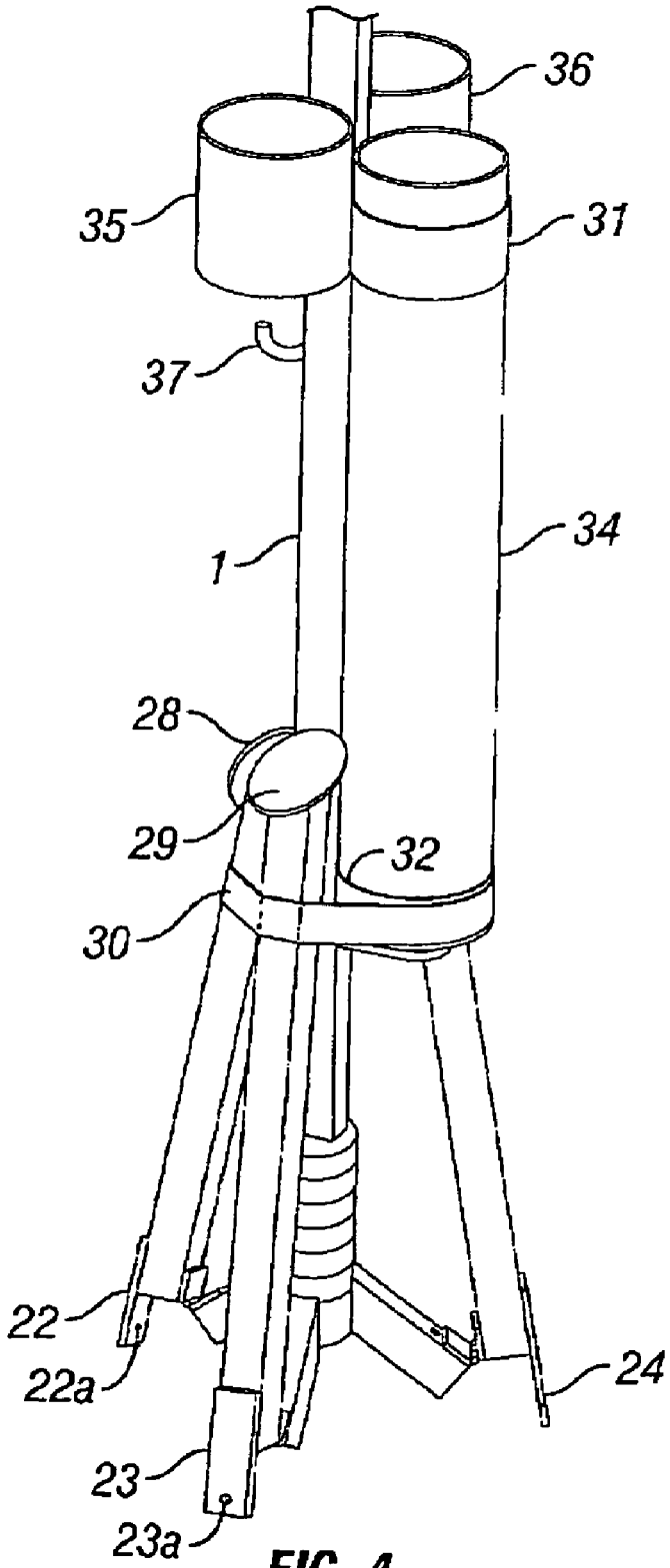
FIG. 4 illustrates the lower housing with the individual legs in a fully raise and collapsed position next to the lower housing.

Referring now to FIG. 3, there is illustrated a part of the procedure wherein the stand is to collapsed and stored for transport to or from the field of use. In FIGS. 3 and 4, the pins 25, 26, and 27 have been removed from apertures 22*a*, 23*a* (FIG. 4), and 24*a*, and corresponding apertures (such as 15*a*) in the upper leg members 13, 14, and 15. The lower leg members 16, 17, and 18 are then pivoted in an upper arc manner toward the lower housing members 1 and 1*a*.

In conjunction with FIG. 4, the lower leg members are shown in the final storage position wherein these members 16, 17, and 18 have been pivoted in an upward manner to be juxtaposed or adjacent with members 1 and 1a. Furthermore, the members 16, 17, and 18 are secured in the folded manner as shown by a strap 38. This strap 38 may be made of any material.

FIG. 4 also discloses the use of bands 31 and 32, permanently affixed to housing member 1, to form a receptacle to hold quiver 34 which in turn holds the arrows to be used in the field. The quiver 34 has an open in the top most portion thereof and a substantially closed end in the very bottom portion thereof. The lower band 32 has a member (not shown) across the bottom portion thereof and which provides a stop plate for the bottom end of quiver 34. This stop plate in turn has an upward formed nipple (not shown) which can be aligned with a small opening (not shown) in the bottom portion of the quiver 34. Band members 35 and 36 are permanently affixed to housing member 1 and are similar in construction as band member 32. These band members 35 and 36 permit the archer to also use these as receptacles to hold items such as water containers and the like. Furthermore, housing member 1 also has affixed thereto a hook 37 for hanging small items there from. Likewise, hook 37*a* is attached to housing member 3.

Figure 5:
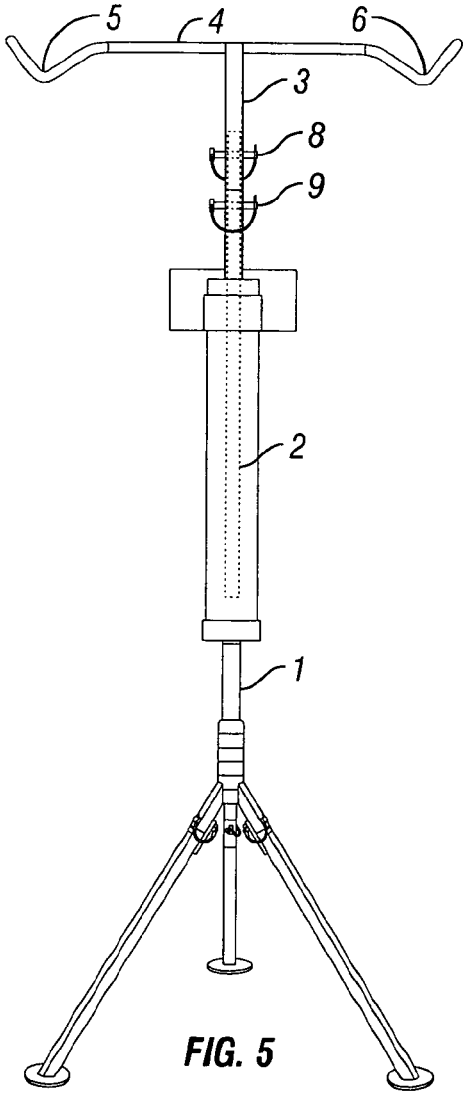
FIG. 5 illustrates the present invention wherein the middle and upper housing members are in a lower orientation for easy reach by children.
Figure 6:
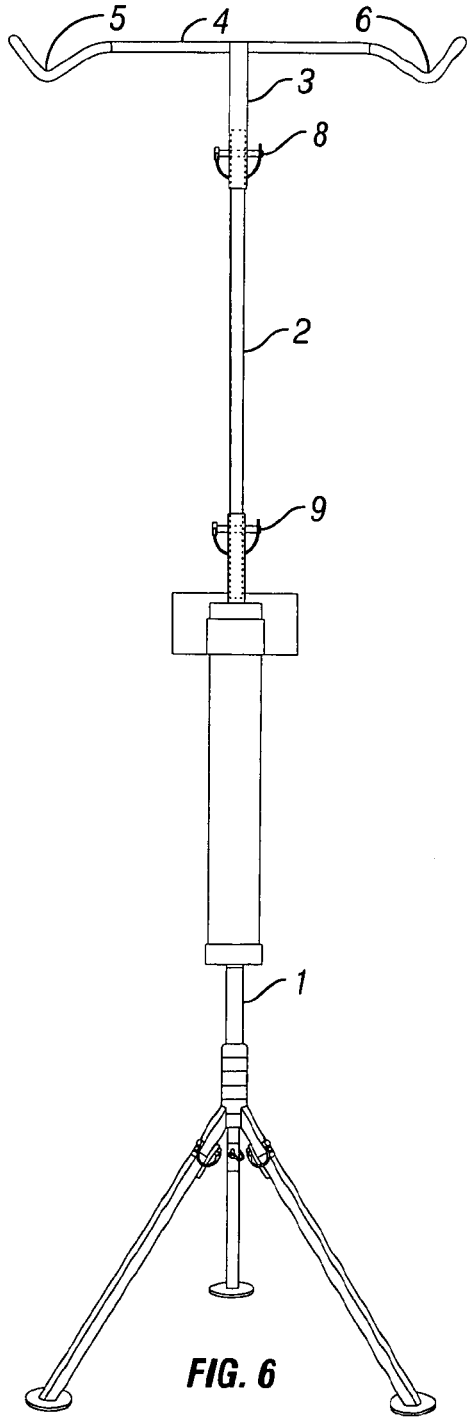
FIG. 6 illustrates the present invention wherein the middle and upper housing members are in an extended orientation for easy reach by adults.

FIGS. 5 and 6 are illustrative of the height adjustment feature of the present invention stand, In FIG. 5, the housing member 2 is shown in a substantially enclosed position within housing member 1 and which permits the housing member 4 to be in its lowest position relative to the ground. In this manner, children can easily reach the compound bow without any upward or downward movements and which may cause damage to the bow. This height adjustment feature permits member 4 to be raised or lowered over a range of from about 1 inch to about 46 inches, depending upon the number of apertures or holes in the respective members.

Figure 7:
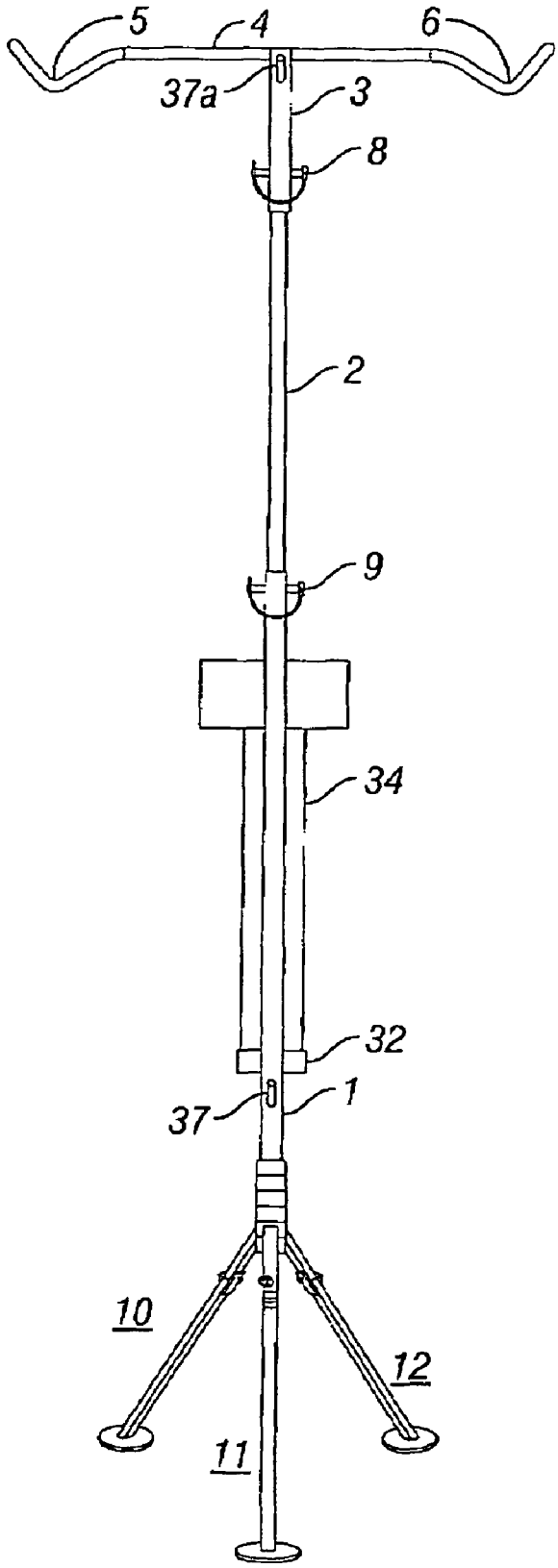
FIG. 7 illustrates the reverse side of FIG. 6.

In FIG. 6, then, it is illustrated wherein the stand is fully extended in an upward manner for providing easy access for adults. Thus, housing member 2 is fully extended out of housing member 1, but still sufficiently enclosed in housing member 1 to provide a stable locking of the two members 1 and 2 by pin 9. FIG. 7 provides another view of this extension, but from the reverse side of FIG. 6.

The materials of the apparatus or stand must be chosen with care so as to provide appropriate and suitable protection, rigidity and overall integrity. The apparatus also can be subjected to a powder coat process such as a polyester powder coat paint. These type finishes provide a super thermosetting powder coating with excellent exterior durability and corrosion resistance designed to meet stringent requirements of structures subjected to outdoor environmental elements.

In conjunction with storage and transportation purposes, the collapsible stand with its three central components, are designed in order that each component is relatively equal in length whereby when placed together, they can be easily fitted, for example, into a cardboard box measuring 8 inches by 8 inches by 48 inches. This permits easy storage and also shipping when purchased from the manufacturer. These unique stands are manufactured and sold under the trade name BOWSAVER by Bowsaver, Inc. of Hallettsville, Tex.

While the principles of the present invention have now been made clear in the illustrations shown herein, there can be some modifications of the structure, arrangement, proportions, elements and components, used in the practice of the invention and which are adapted for specific environments and operating requirements without departing from those principles.

The present invention thus provides the following items in order to achieve the objectives of a unique collapsible compound bow and arrow stand according to the descriptions contained herein:

1. A collapsible, stable bow and arrow stand/apparatus comprising in combination
   (a) a first elongated housing member comprising (1) an upper portion which is hollow and containing at least two apertures therein; (2) a bottom portion having affixed thereto multiple legs for support of said first housing member, each of said legs having a first portion which is the upper end of said leg and which is permanently affixed to said bottom portion of said first housing member, and a second portion which is the lower end of said leg, said upper and lower portions of said leg being connected by a hinge mechanism which permits said lower portion of said leg to be pivoted in an upward and downward manner to be juxtaposed with said first housing member when in a collapsible position and in a downward and locked manner when in use;
   (b) a second elongated housing member having at least two apertures therein and configured such as to allow the second housing to be inserted into the hollow portion of said first housing member depending upon the desired height of the overall stand, said apertures in said first and second housing members to be aligned in order that a pin can be inserted there through and act as a locking mechanism there for;
   (c) a third elongated housing member having at least one aperture therein and further having affixed to the upper portion of said third housing member a laterally extending member with depressions therein, to hang compound bows there from, and being substantially equally distant from the third housing member, said third housing member having a lower hollow portion thereof and configured such as to permit the second housing member to be inserted into the hollow portion of the third housing member, said apertures in the second and third housing members capable of being aligned in order that a pin can be inserted there through and act as a locking mechanism there for.
2. The apparatus as set forth in item 1 wherein the number of legs is three and are equally spaced around the bottom portion of said first housing member, said lower end of each of the bottom portion of said legs having a fourth member attached thereto which is larger than the cross section of said leg and acts as further means to stabilize the said stand.
3. The apparatus as set forth in item 2 wherein the first housing member has spaced around the upper and bottom portions thereof at least two or more hollow members, and said hollow members being in alignment with each other in order to support a quiver being inserted there into.
4. The apparatus as set forth in item 3 wherein the bottom hollow member has means for providing a support for the quiver when inserted into the top and bottom members.
5. The apparatus as set forth in item 4 wherein the fourth member has an aperture therein in order to permit fluid drainage from said legs.
6. The apparatus as set forth in item 5 wherein the apparatus has a powder coating finish thereon.

What is claimed is:

1. A collapsible, stable bow and arrow stand comprising in combination
   (a) a first elongated housing member comprising (1) an upper portion which is hollow and containing at least two apertures therein; (2) a bottom portion having affixed thereto three legs for support of said first housing member, each of said legs having a first portion which is the upper end of said leg and which is permanently affixed to said bottom portion of said first housing member, and a second portion which is the lower end of said leg, said upper and lower portions of said leg being connected by a hinge mechanism which permits said lower portion of said leg to be pivoted (i) in an upward manner to be in an axis substantially parallel with the axis of said first housing member when in a collapsible position , and (ii) in a downward manner to be in an axis which is substantially non-parallel with the axis of said first housing member when in use, and wherein said leg is in a locked manner when said stand is being used;
   (b) a second elongated housing member having at least two apertures therein and configured such as to allow the second housing to be inserted into the hollow portion of said first housing member depending upon the desired height of the overall stand in order to accommodate the height of the person using said stand, said apertures in said first and second housing members to be aligned in order that a pin can be inserted there through and act as a locking mechanism there for;

(c) a third elongated housing member having at least one aperture therein and further having affixed to the upper portion of said third housing member a laterally extending member with depressions therein, to hang compound bows there from, and being substantially equally distant from the third housing member, said third housing member having a lower hollow portion configured such as to permit the second housing member to be inserted into the hollow portion of the third housing member , said apertures in the second and third housing members capable of being aligned in order that a pin can be inserted there through and act as a locking mechanism there for;

(d) a fourth member attached to the bottom portion of the lower leg and which provides additional stability for said stand, said fourth member having a cross section thereof which is larger than the cross section of said lower leg;

with the proviso that (1) the legs are equally spaced around the bottom portion of said first housing member; (2) the first housing member has spaced around the upper and bottom portions thereof at least two or more hollow members, said hollow members being in alignment with each other in order to support a quiver being inserted there into; (3) the stand has a powder coating finish thereon; and (4) the stand, when in a fully collapsed position, can be fitted into a box measuring 8 inches by 8 inches by 48 inches.

* * * * *